US006561366B2

(12) United States Patent
Kim-So

(10) Patent No.: US 6,561,366 B2
(45) Date of Patent: May 13, 2003

(54) DETACHABLE DISPLAY RACK FOR HANGING DISPLAY ITEMS THEREON

(76) Inventor: Cynthia Kim-So, 200 W. Pico Blvd., Los Angeles, CA (US) 90015

( * ) Notice: Subject to any disclaimer, the term of this patent is extended or adjusted under 35 U.S.C. 154(b) by 0 days.

(21) Appl. No.: 09/932,384

(22) Filed: Aug. 17, 2001

(65) Prior Publication Data

US 2003/0034320 A1 Feb. 20, 2003

(51) Int. Cl.[7] ..... A47B 43/00

(52) U.S. Cl. ..... 211/189; 211/206

(58) Field of Search ..... 211/195, 189, 211/206, 191, 192, 182, 181.1, 187, 105.1; 248/128, 150, 151, 165–166, 146, 158–159; 280/79.3; 312/108, 257.1, 258, 264, 265.1–265.6, 107; 52/238.1, 36.1, 481.2

(56) References Cited

U.S. PATENT DOCUMENTS

| | | | | | |
|---|---|---|---|---|---|
| 430,340 | A | * | 6/1890 | Eyles | 211/195 |
| 1,708,588 | A | * | 4/1929 | Proctor | 211/189 |
| 3,332,558 | A | * | 7/1967 | Wilson | 211/181.1 |
| 3,503,525 | A | * | 3/1970 | Loebner | 211/177 |
| 3,589,746 | A | * | 6/1971 | Inglis et al. | 108/181 |
| 3,730,108 | A | * | 5/1973 | Stroh | 108/108 |
| 3,833,279 | A | * | 9/1974 | MacKenzie, Jr. | 312/140 |
| 3,941,251 | A | * | 3/1976 | Izen | 211/162 |
| 4,380,298 | A | * | 4/1983 | Harig | 211/182 |
| 5,169,009 | A | * | 12/1992 | Bomze | 211/187 |
| 5,195,642 | A | * | 3/1993 | Dardashti | 211/189 |
| 5,310,066 | A | * | 5/1994 | Konstant | 108/109 |
| 5,330,066 | A | * | 7/1994 | Carroll | 211/182 |
| 5,535,898 | A | * | 7/1996 | Burgess et al. | 211/189 |
| 5,660,637 | A | * | 8/1997 | Dodge | 118/500 |
| 5,894,945 | A | * | 4/1999 | Curran | 211/162 |
| 5,934,485 | A | * | 8/1999 | Harris et al. | 211/189 |
| 6,029,833 | A | * | 2/2000 | Yeh | 108/108 |
| 6,105,797 | A | * | 8/2000 | Haisma | 211/130.1 |
| 6,240,687 | B1 | * | 6/2001 | Chong | 220/668 |
| 6,293,637 | B1 | * | 9/2001 | Anderson et al. | 211/26 |
| 6,308,842 | B1 | * | 10/2001 | Robbins et al. | 206/494 |
| 6,401,947 | B1 | * | 6/2002 | Hu et al. | 211/186 |
| 6,401,948 | B1 | * | 6/2002 | Huang | 211/206 |

* cited by examiner

*Primary Examiner*—Daniel P. Stodola
*Assistant Examiner*—Jennifer E. Novosad
(74) *Attorney, Agent, or Firm*—Jerry H. Noh

(57) ABSTRACT

A display rack having a pair of side posts with each side post having a inner sub-post member and an outer sub-post member. The inner sub-post member and outer sub-post member being connected by a front row of horizontally parallel crossbars and a rear row of horizontally parallel crossbars. An elongated base member being removeably attached below each of the first and second posts. The upper ends of the side posts being removeably connected by a pair of parallel top frame bars, and the lower ends of the side posts being removeably connected by a bottom frame bar.

19 Claims, 8 Drawing Sheets

DETACHABLE DISPLAY RACK FOR HANGING DISPLAY ITEMS THEREON

BACKGROUND OF THE INVENTION

1. Field of the Invention

The invention relates to a display structures. More particularly, the present invention relates to an improved versatile display rack for hanging miscellaneous items thereon.

2. Description of Prior Art

There are many styles of display racks and devices for hanging miscellaneous items such as clothing, hats, accessories, and bags. One. type conventional display rack has two or more dual columned side posts connected by a plurality of horizontal bars. This conventional display rack has a base member connected below each of the side posts for providing balance and support. This rack is fairly large and a disadvantage of this rack is that all of the parts are welded together, which makes transportation of this rack laborious. Further, on this type of rack, clothing can only be hung either from the front side or the back side of the rack. None of the prior art teaches the display rack as taught by the present invention.

It is a primary objective of the present invention to provide a versatile display rack which can be easily disassembled and assembled. It is another objective of the present invention to provide a display rack on which display items can be hung from the front, back, and sides of the display rack.

SUMMARY OF THE INVENTION

The present invention is contrived to overcome the conventional disadvantages. As shown in FIGS. 1 and 5, the display rack can be disassembled, and reassembled as shown in FIGS. 2 and 6. The display rack has two or more side posts with each side post having an inner sub-post member and an outer sub-post member. Placed between and connecting the inner sub-post member and outer sub-post member is a front row of horizontally parallel crossbars facing the front side of the display rack and a rear row of horizontally parallel crossbars facing the rear side of the display rack.

An elongated base member is removeably attached below each of the first and second side posts to provide balance and stable support.

The upper ends of the side posts are removeably connected by a pair of parallel top frame bars, and the lower ends of the side posts are removeably connected by a bottom frame bar. A plurality of hanging bars can be hung from the front side or rear side of the display rack, and a plurality of hanging arms can be hung on the crossbars to protrude to the side of the display rack. Additional side posts can be attached to the display rack to extend the display rack sideways.

DETAILED DESCRIPTION OF THE PREFERRED EMBODIMENTS

Figure 1:
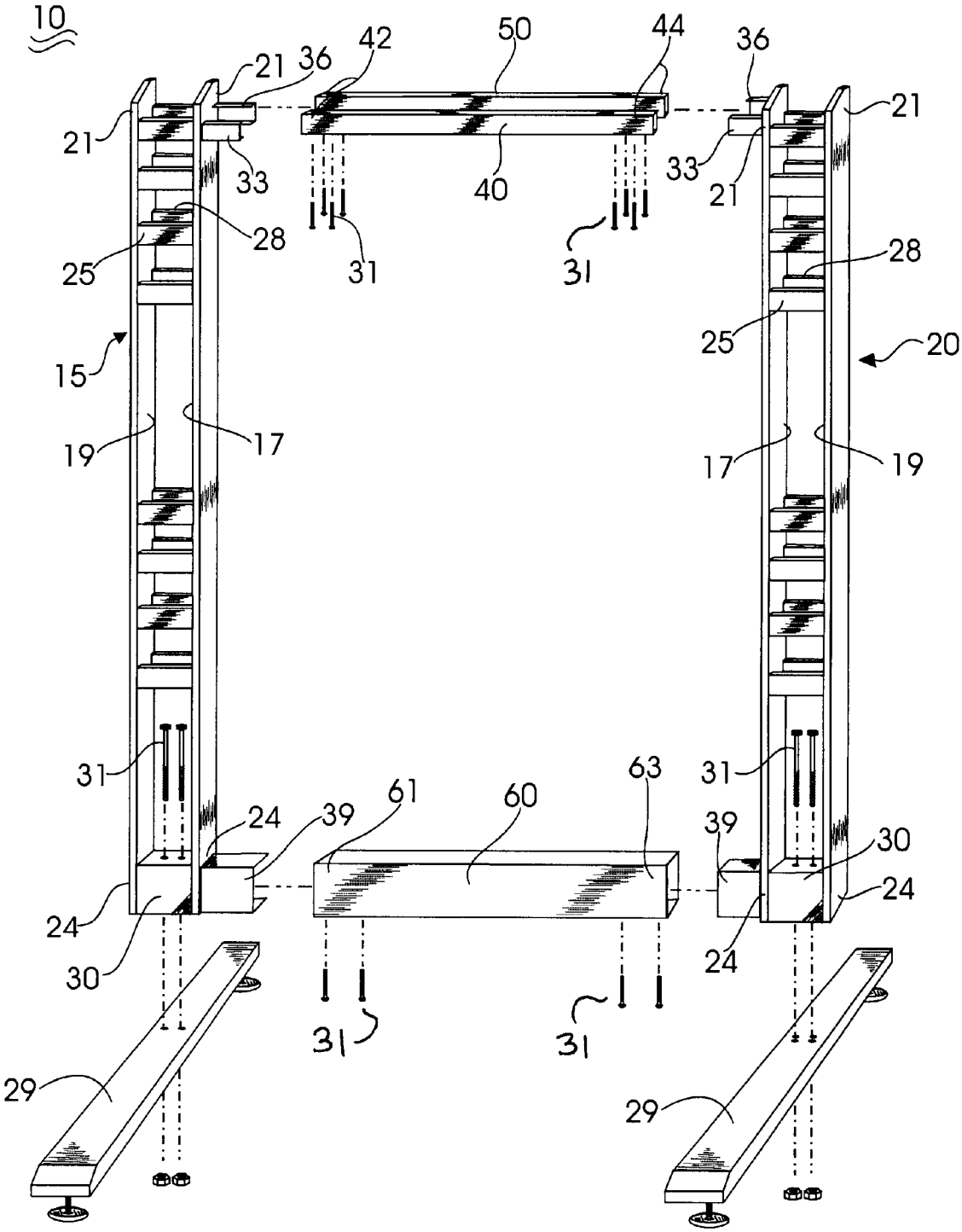
FIG. 1 is an exploded perspective view of the display rack according to the present invention.
Figure 1A:
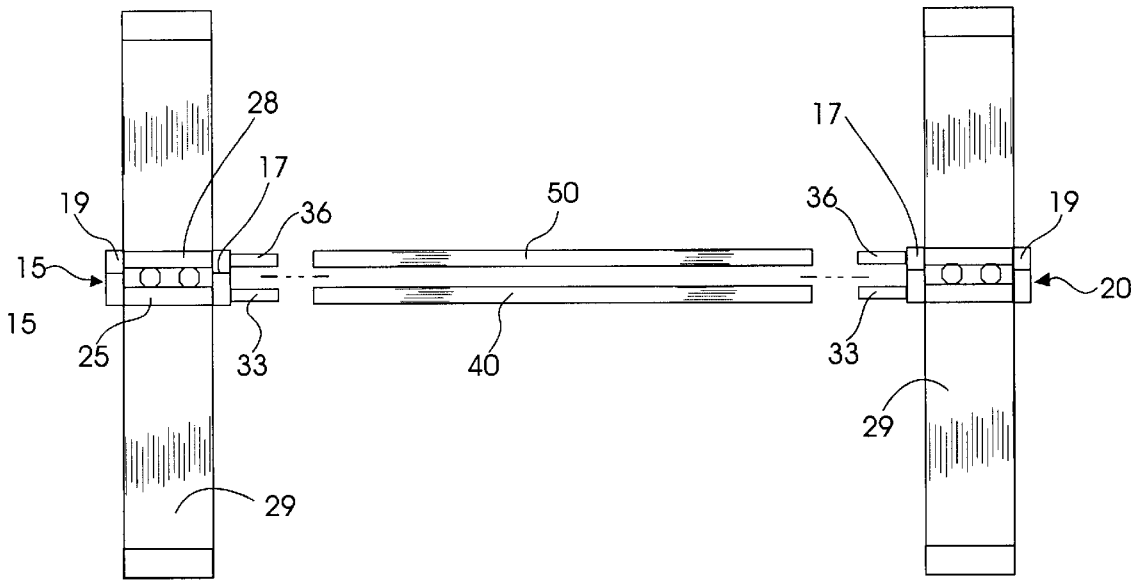
FIG. 1A is an exploded top plan view of the display rack according to the present invention.

With reference to the accompanying drawings, a display rack 10 for hanging miscellaneous items thereon according to the present invention will now be described. The display rack 10 comprises a first side post 15 and a second side post 20. Each side post 15, 20 has an inner sub-post member 17 and an outer sub-post member 19, and each of the inner sub-post member 17 is spaced apart from and parallel to the outer sub-post member 19. Furthermore, each inner sub-post member 17 and outer sub-post member 19 has an upper end 21 and a lower end 24. Placed between and connecting the inner sub-post member 17 and outer sub-post member 19 is a front row of horizontally parallel crossbars 25. The front row of crossbars 25 face the front side of the display rack 10. Also placed between and connecting the inner sub-post member 17 and outer sub-post member 19 is a rear row of horizontally parallel crossbars 28. The rear row of crossbars 28 face the rear side of the display rack 10. Also, a connection block 30 can connect the lower ends 24 of each of the inner sub-post member 17 and outer sub-post member 19.

An elongated base member 29 is removeably attached below each of the first and second posts 15, 20 beneath the connection block 30. The base member 29 extends sufficiently forward and rearward from the display rack 10 to provide balance and stable support. Each base member 29 can be removeably attached beneath the connection block using a threaded bolt 31 extending through both the connection block 30 and the base member 29.

A first connection member 33 and a second connection member 36 protrudes from the upper end 21 of each of the inner sub-post members 17. Also, a bottom connection member 39 protrudes from the lower end 24 of each of the inner sub-post members 17.

The display rack 10 further includes a front top frame bar 40 and a rear top frame bar 50 adjacent and parallel to the front top frame bar 40. Both front and rear top frame bars 40, 50 has an open first end 42 and an open second end 44. The first end 42 of the front top frame bar 40 slides over and removeably connects to the first connection member 33 of the inner sub-post member 17 of the first side post 15, and the second end 44 of the front top frame bar 40 slides over and removeably connects to the first connection member 33 of the upper end 21 of the inner sub-post member 17 of the second side post 20. The first end 42 of the rear top frame bar 50 slides over and removeably connects to the second connection member 36 of the inner sub-post member 17 of the first side post 15, and the second end 44 of the rear top frame bar 50 slides over and removeably connects to the second connection member 36 of the upper end 21 of the inner sub-post member 17 of the second side post 20. The removeable attachment can be accomplished as shown in FIG. I through use of a threaded bolt 31 extending through the ends 42, 44 of the frame bars 40, 50 and the corresponding connection members 33, 36.

The display frame 10 further includes a bottom frame bar 60 having an open first end 61 and an open second end 63. The first end 61 of the bottom frame bar 60 slides over and removeably connects to the bottom connection member 39 of the lower end 24 of the inner sub-post member 17 of the first side post 15, and the second end 63 of the bottom frame bar 60 slides over and removeably connects to the bottom connection member 39 of the lower end 24 of the inner sub-post member 17 of the second side post 20. The removeable attachment can be accomplished as shown in FIG. I through use of a threaded bolt 31 extending through the ends 61, 63 of the frame bar 60 and the corresponding connection member 39.

Figure 3:
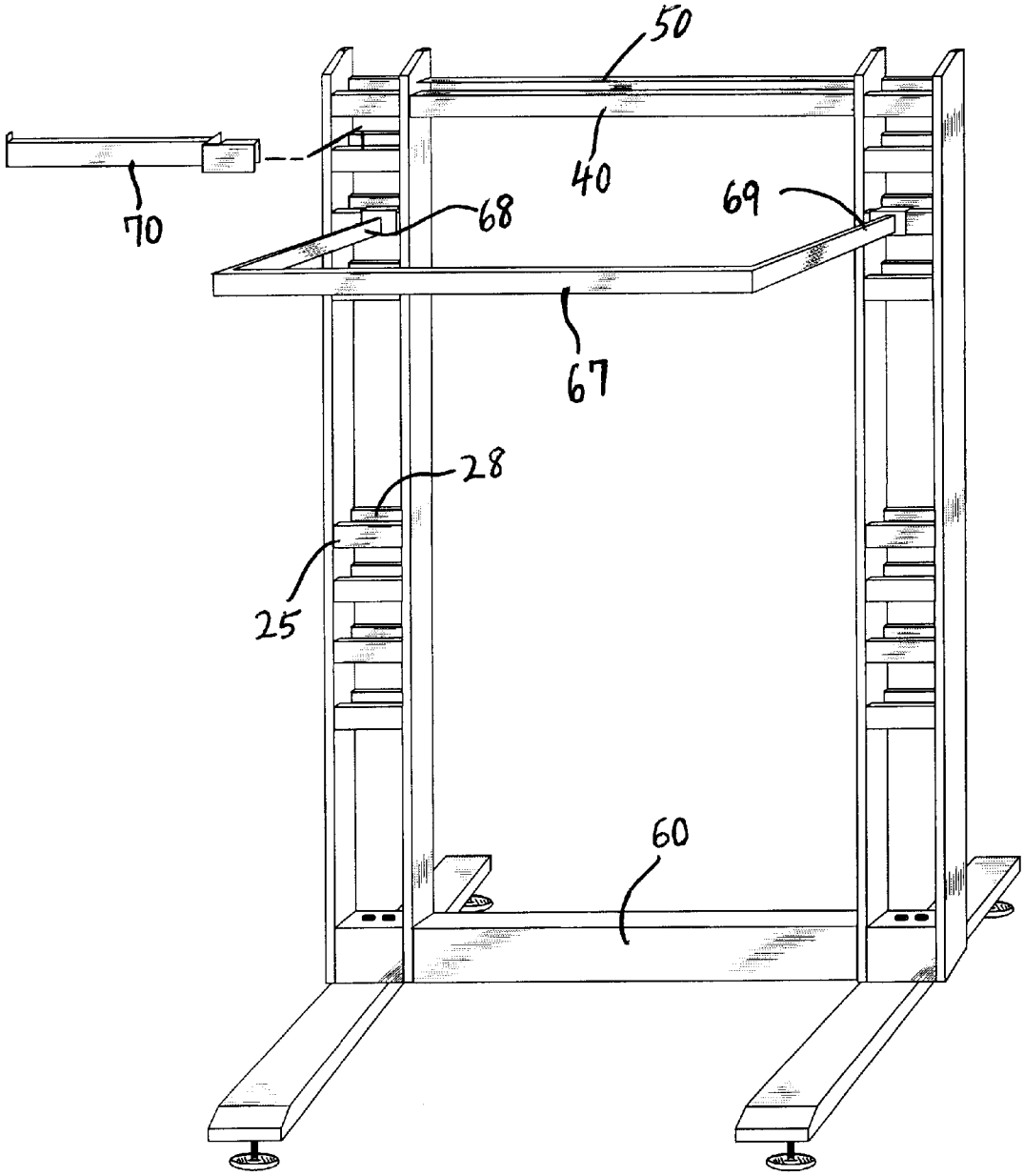
FIG. 3 is an assembled perspective view of the display rack according to the present invention showing an attached hanging bar and a detached hanging arm.
Figure 4:
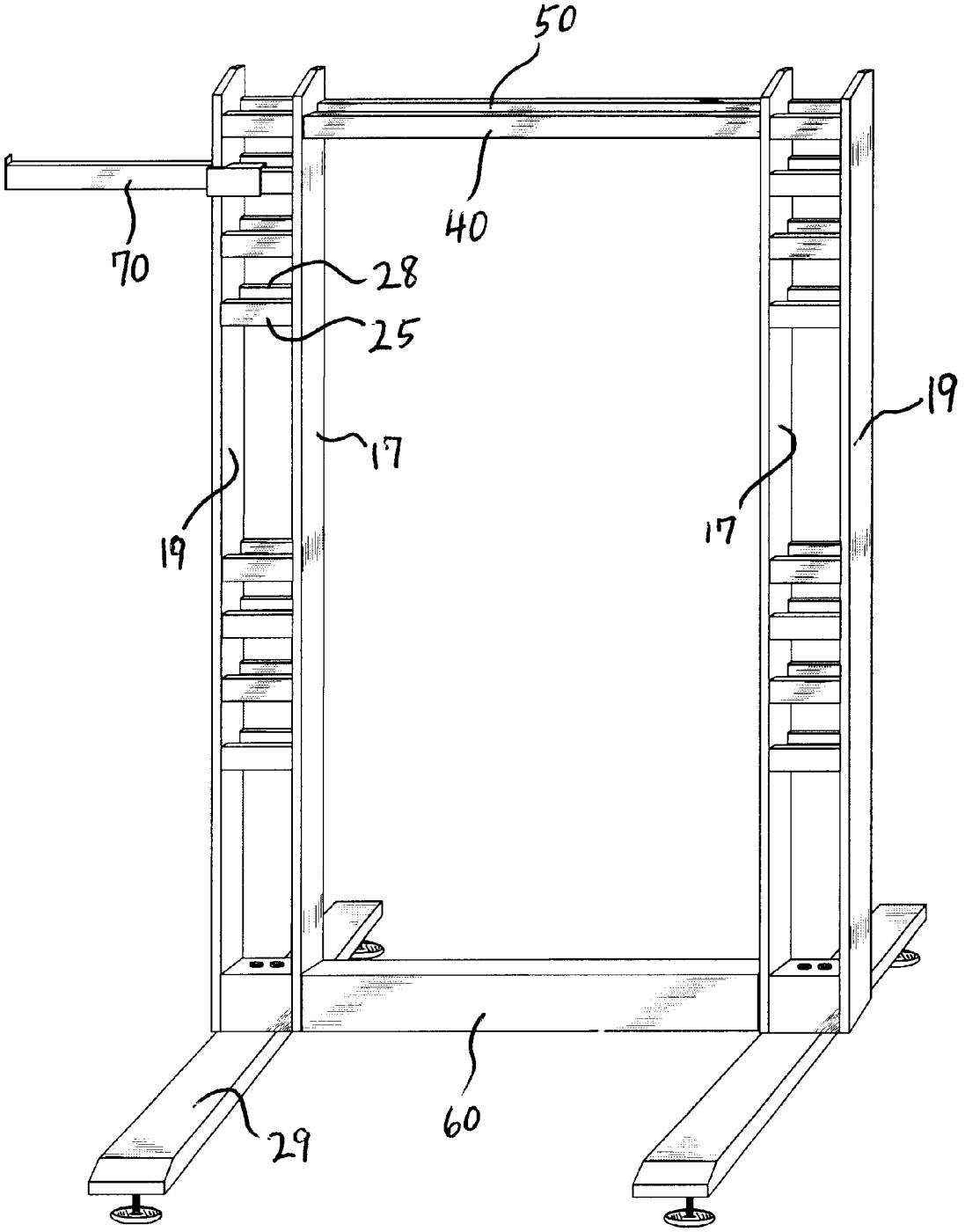
FIG. 4 is an assembled perspective view of the display rack according to the present invention with an attached hanging arm.

As shown in FIG. 3, the display rack 10 can further include at least one hanging bar or arm 67 having a first end 68 and a second end 69. The hanging bar 67 protrudes from a face of display rack 10 with the first end 68 removeably hung on the crossbar 25 located on the first side post 15 and the second end 69 removeably hung on the crossbar 25 located on the second side post 20. Also, the display rack 10 as shown in FIGS. 3 and 4 can further comprise at least one hanging arm 70 hung on the crossbar 28 and protruding to the side of the display rack 10.

Figure 5:
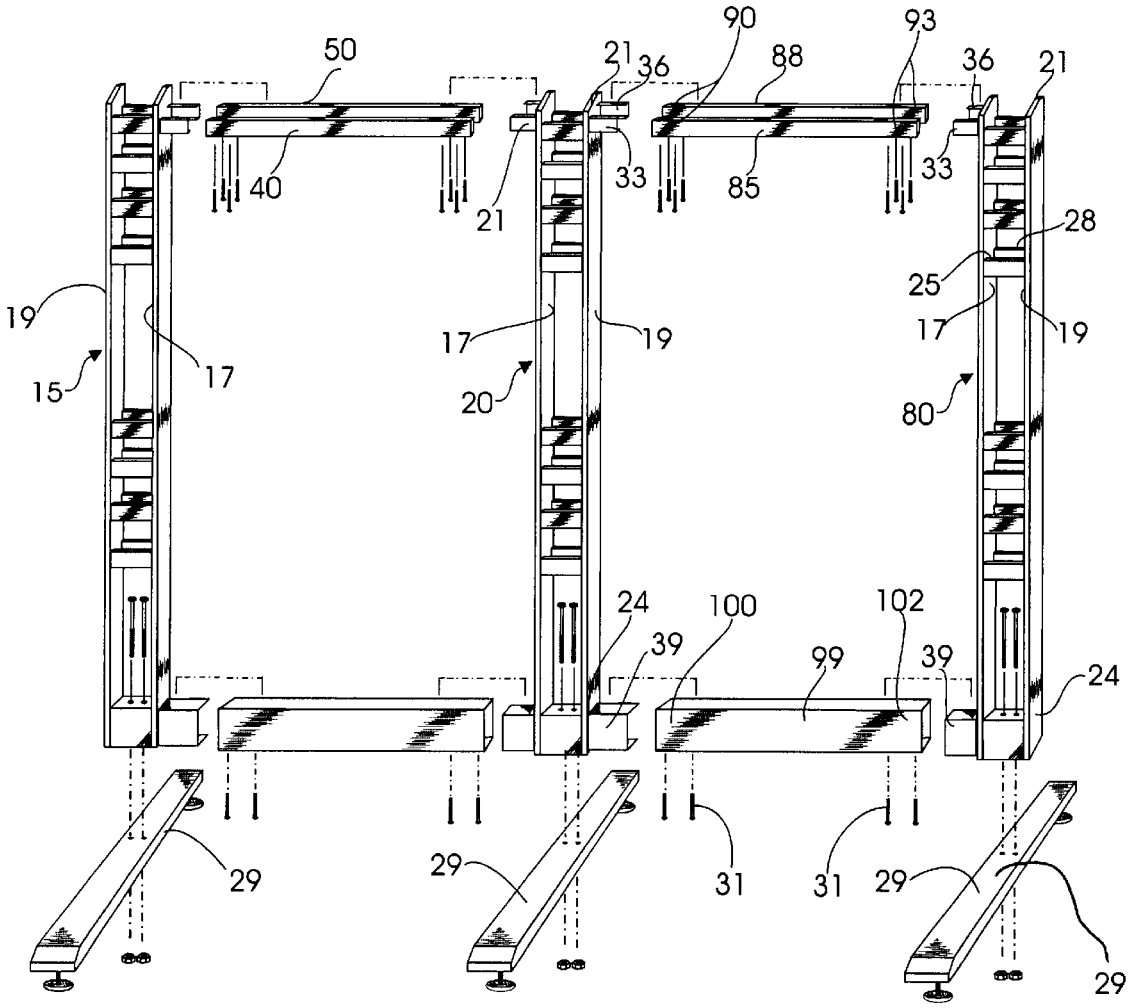
FIG. 5 is an exploded perspective view of a three side post embodiment of the display rack according to the present invention; and, FIG. 6 is an assembled perspective view of a three side post embodiment of the display rack according to the present invention.
Figure 6:
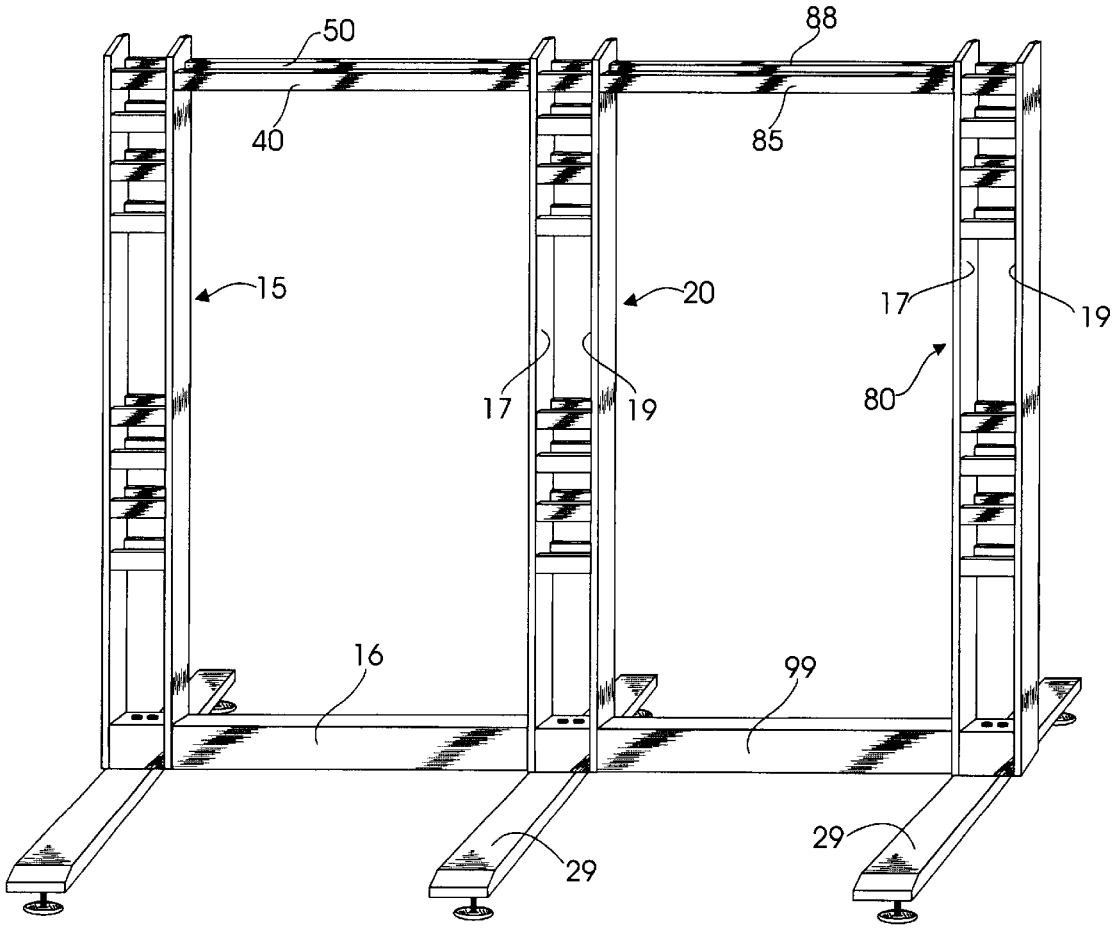

As shown in FIGS. 5 and 6, the display rack 10 can be extended sideways in an alternative three side post embodiment by removeably attaching a third side post 80 having an inner sub-post member 17 and an outer sub-post member 19. Similar to the first and second side posts 15, 20, the inner sub-post member 17 of the third side post 80 is spaced apart from and parallel to the outer sub-post member 19, and the inner sub-post member 17 and outer sub-post member 19 of the third side post 80 have an upper end 21 and a lower end 24. Also, the third side post 80 has a front row of horizontally parallel crossbars 25 and a rear row of horizontally parallel crossbars 28 placed between and connecting the inner sub-post member 17 and the outer sub-post member 19. Also, for the third side post 80, a connection block 30 can connect the lower ends 24 of the inner sub-post member 17 and outer sub-post member 19. An elongated base member 29 is removeably attached below the third side posts 80 beneath the connection block 30. The base member 29 extends sufficiently forward and rearward from the display rack 10 to provide balance and stable support. The base member 29 of the third side post 80 can be removeably attached beneath the connection block using a threaded bolt 31 extending through both the connection block 30 and the base member 29.

In the three side post embodiment, a first connection member 33 and a second connection 36 member protrudes from the upper end 21 of the inner sub-post member 17 of the third side post 80 and from the upper end 21 of the outer sub-post member 19 of the second side post 20.

Also, in the three side post embodiment, a bottom connection member 39 protrudes from the lower end 24 of the inner sub-post member 17 of the third side post 80 and from the lower end 24 of the outer sub-post member 19 of the second side post 20. The three side post embodiment further includes a second front top frame bar 85 and a second rear top frame bar 88 located behind and parallel to the second front top frame bar 85. Each frame bar 85, 88 has an open first end 90 and an open second end 93. The first end 90 of the second front top frame bar 85 slides over and removeably connects to the first connection member 33 of the upper end 21 of the outer sub-post member 19 of the second side post 20, and the second end 93 of the second front top frame bar 85 slides over and removeably connects to the first connection member 33 of the upper end 21 of the inner sub-post member 17 of the third side post 80. The second rear top frame bar 88 has its first end 90 sliding over and removeably connecting to the second connection member 36 of the upper end 21 of the outer sub-post member 19 of the second side post 20 and its second end 93 sliding over and removeably connecting to the second connection member 36 of the upper end 21 of the inner sub-post member 17 of the third side post 80.

The three side post embodiment further includes a second bottom frame bar 99 having an open first end 100 and an open second end 102 with the first end 100 sliding over and removeably connecting to the bottom connection member 39 of the lower end 24 of the outer sub-post member 19 of the second side post 20 and with the second end 102 sliding over and removeably connecting to the bottom connection member 39 of the lower end 24 of the inner sub-post member 17 of the third side post 80.

Figure 2:
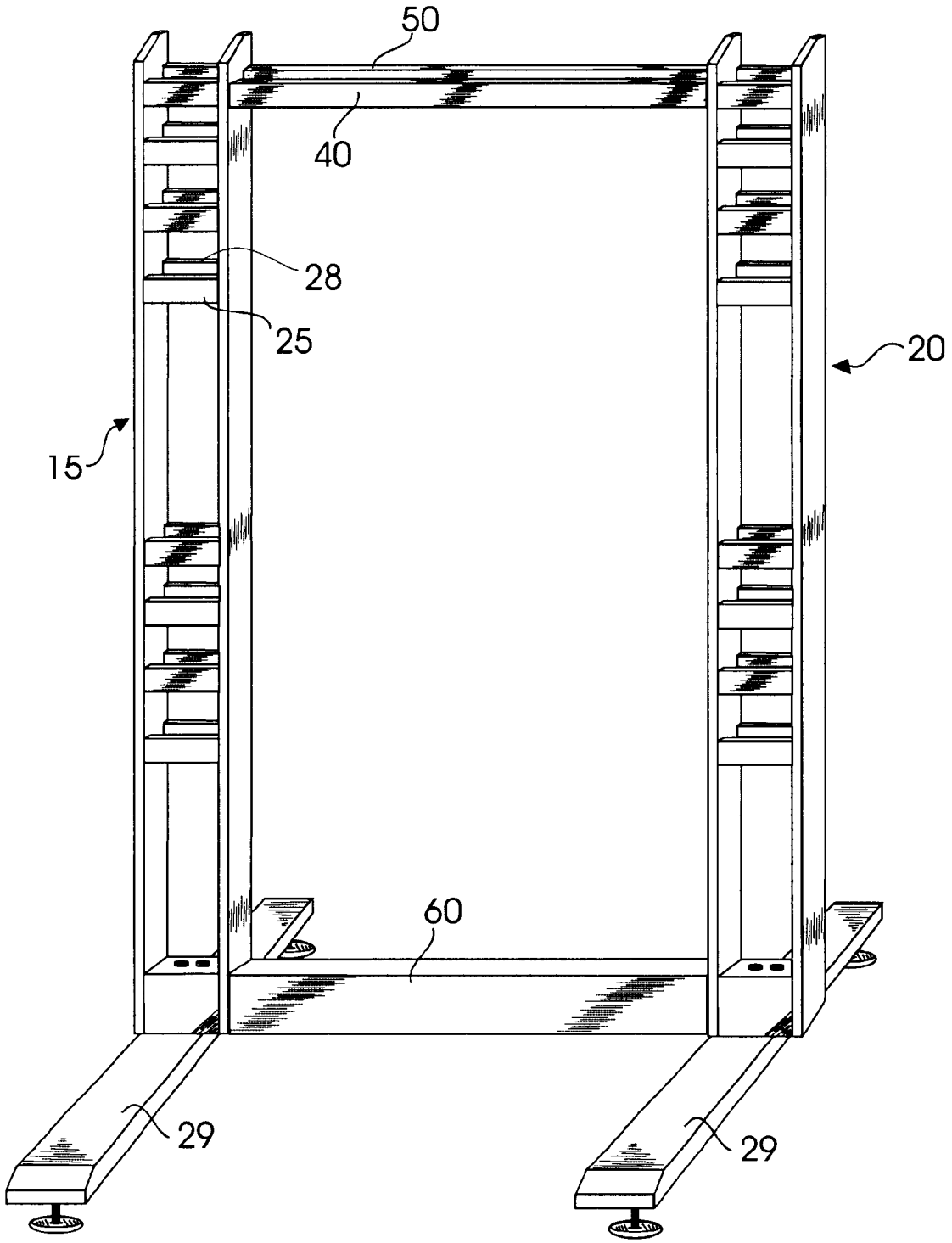
FIG. 2 is an assembled perspective view of the display rack according to the present invention.
Figure 2A:
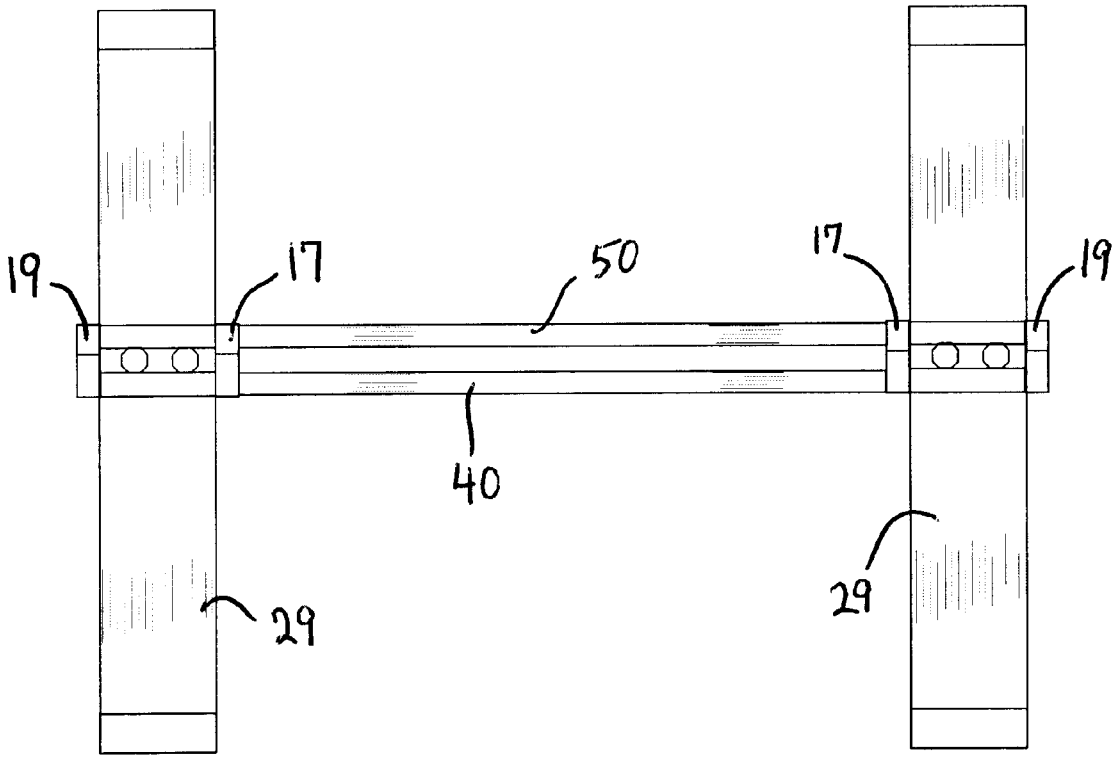
FIG. 2A is an assembled top plan view of the display rack according to the present invention.

As shown in FIG. 1 and 5, the display rack can be disassembled at the removeable connections described in the disclosure for easy transport. FIG. 2 and 6 show the display rack in the fully assembled state.

Although a preferred embodiment of the invention has been described and illustrated for purposes of clarity and example, it should be understood that many changes, substitutions and modifications to the described embodiment will be apparent to those having skill in the art in light of the foregoing disclosure without departing from the scope and spirit of the present invention which is defined by the claims which follow.

What is claimed is:

1. A display rack for hanging miscellaneous items thereon, said rack comprising:

a first side post and a second side post, each side post having an inner sub-post member and an outer sub-post member, each said inner sub-post member being spaced apart from and parallel to a respective said outer sub-post member, each inner sub-post member and outer sub-post member having an upper end and a lower end;

a front row of horizontally parallel crossbars disposed between and connecting together each of said inner and outer sub-post members of said first and second side posts;

a rear row of horizontally parallel crossbars disposed between and connecting together each of said inner and outer sub-post members of said first and second side posts;

a front top frame bar having a first end and a second end, said first end removeably connected to said upper end of said inner sub-post member of said first side post, said second end removeably connected to said upper end of said inner sub-post member of said second side post;

a rear top frame bar having a first end and a second end, said rear top frame bar being disposed behind and parallel to said front top frame bar, said first end of said rear top frame bar removeably connected to said upper end of said inner sub-post member of said first side post, said second end of said rear top frame bar removeably connected to said upper end of said inner sub-post member of said second side post;

a bottom frame bar having a first end and a second end, said first end of said bottom frame bar removeably connected to said lower end of said inner sub-post member of said first side post, said second end of said bottom frame bar removeably connected to said lower end of said inner sub-post member of said second side post; and, an elongated base member removeably attached beneath the lower end of each of said first and second side posts.

2. The display rack as described in claim 1 further comprising a connection block connecting together the lower ends of each of said inner sub-post member and outer sub-post member of each said first and second side posts.

3. The display rack as described in claim 1 further comprising at least one hanging bar having a first end and a second end, said hanging bar protruding from a face of said display rack, said first end removeably hung on a selected one of said crossbars disposed on said first side post and said second end removeably hung on a predetermined crossbar disposed on said second side post.

4. The display rack as described in claim 1 further comprising at least one hanging arm hung on a selected one of said crossbars and protruding therefrom.

5. A display rack for hanging miscellaneous items thereon, said rack comprising:

a first side post and a second side post, each side post having an inner sub-post member and an outer sub-post member, each said inner sub-post member being spaced apart from and parallel to a respective said outer sub-post member, each inner sub-post member and outer sub-post member having an upper end and a lower end;

a front row of horizontally parallel crossbars disposed between and connecting together each of said inner and outer sub-post members of said first and second side posts;

a rear row of horizontally parallel crossbars disposed between and connecting together each of said inner and outer sub-post members of said first and second side posts;

a first connection member and a second connection member protruding from the upper end of each of said inner sub-post members;

a bottom connection member protruding from the lower end of each of said inner sub-post members;

a front top frame bar having an open first end and an open second end, said first end sliding over and removeably connected to said first connection member of said inner sub-post member of said first side post, said second end sliding over and removeably connected to said first connection member of said upper end of said inner sub-post member of said second side post;

a rear top frame bar having an open first end and an open second end, said rear top frame bar being disposed behind and parallel to said front top frame bar, said first end of said rear top frame bar sliding over and removeably connected to said second connection member of said upper end of said inner sub-post member of said first side post, said second end of said rear top frame bar sliding over and removeably connected to said second connection member of said upper end of said inner sub-post member of said second side post;

a bottom frame bar having an open first end and an open second end, said first end of said bottom frame bar sliding over and removeably connected to said bottom connection member of said lower end of said inner sub-post member of said first side post, said second end of said bottom frame bar sliding over and removeably connected to bottom connection member of said lower end of said inner sub-post member of said second side post; and, an elongated base member removeably attached beneath the lower end of each of said first and second side posts.

6. A display rack as described in claim 5 further comprising a connection block connecting together the lower ends of each of said inner sub-post member and outer sub-post member of each said first and second side posts.

7. The display rack as described in claim 5 further comprising at least one hanging bar having a first end and a second end, said hanging bar protruding from a face of said display rack, said first end removeably hung on a selected one of said crossbars disposed on said first side post and said second end removeably hung on a selected one of said crossbars disposed on said second side post.

8. The display rack as described in claim 5 further comprising at least one hanging arm hung on a selected one of said crossbars and protruding therefrom.

9. A display rack for hanging miscellaneous items thereon, said rack comprising:

a first side post and a second side post, each side post having an inner sub-post member and an outer sub-post member, each said inner sub-post member being spaced apart from and parallel to a respective said outer sub-post member, each inner sub-post member and outer sub-post member having an upper end and a lower end, said lower end of said inner sub-post member of each said post being connected to a respective said lower end of said outer sub-post member by a connection block;

a front row of horizontally parallel crossbars disposed between each of said inner and outer sub-post members of said first and second side posts;

a rear row of horizontally parallel crossbars disposed between each of said inner and outer sub-post members of said first and second side posts;

a top frame bar having a first end and a second end, said first end removeably connected to said upper end of said inner sub-post member of said first side post, said second end removeably connected to said upper end of said inner sub-post member of said second side post;

a bottom frame bar having a first end and a second end, said first end of said bottom frame bar removeably connected to said lower end of said inner sub-post member of said first side post, said second end of said bottom frame bar removeably connected to said lower end of said inner sub-post member of said second side post; and, an elongated base member removeably attached beneath the connection blocks of each of said first and second side posts.

10. The display rack as described in claim 9 further comprising at least one hanging bar having a first end and a second end, said hanging bar protruding from a face of said display rack, said first end removeably hung on a predetermined crossbar disposed on said first side post and said second end removeably hung on a predetermined crossbar disposed on said second side post.

11. The display rack as described in claim 9 further comprising at least one hanging arm hung on a selected one of said crossbars and protruding therefrom.

12. A display rack for hanging miscellaneous items thereon, said rack comprising:

a first side post and a second side post, each side post having an inner sub-post member and an outer sub-post member, each said inner sub-post member being spaced apart from and parallel to a respective said outer sub-post member, each inner sub-post member and outer sub-post member having an upper end and a lower end;

a third side post having an inner sub-post member and an outer sub-post member, said inner sub-post member being spaced apart from and parallel to said outer sub-post member, said inner sub-post member and outer sub-post member having an upper end and a lower end;

a front row of horizontally parallel crossbars disposed between and connecting together each of said inner and outer sub-post members of said first, second, and third side posts;

a rear row of horizontally parallel crossbars disposed between and connecting together each of said inner and outer sub-post members of said first, second, and third side posts;

a front top frame bar having a first end and a second end, said first end removeably connected to said upper end of said inner sub-post member of said first side post, said second end removeably connected to said upper end of said inner sub-post member of said second side post;

a rear top frame bar having a first end and a second end, said rear top frame bar being disposed behind and parallel to said front top frame bar, said first end of said rear top frame bar removeably connected to said upper end of said inner sub-post member of said first side post, said second end of said rear top frame bar removeably connected to said upper end of said inner sub-post member of said second side post;

a bottom frame bar having a first end and a second end, said first end of said bottom frame bar removeably connected to said lower end of said inner sub-post member of said first side post, said second end of said bottom frame bar removeably connected to said lower end of said inner sub-post member of said second side post;

a second front top frame bar having a first end and a second end, said first end removeably connected to said upper end of said outer sub-post member of said second side post, said second end removeably connected to said upper end of said inner sub-post member of said third side post;

a second rear top frame bar having a first end and a second end, said rear top frame bar being disposed behind and parallel to said second front top frame bar, said first end of said rear top frame bar removeably connected to said upper end of said outer sub-post member of said second side post, said second end of said rear top frame bar removeably connected to said upper end of said inner sub-post member of said third side post;

a second bottom frame bar having a first end and a second end, said first end of said second bottom frame bar removeably connected to said lower end of said outer sub-post member of said second side post, said second end of said second bottom frame bar removeably connected to said lower end of said inner sub-post member of said third side post; and, an elongated base member removeably attached beneath the lower end of each of said first and second and third side posts.

13. The display rack as described in claim 12 further comprising a connection block connecting together the lower ends of each of said inner sub-post member and outer sub-post member of each said first, second, and third side posts.

14. The display rack as described in claim 12 further comprising at least one hanging bar having a first end and a second end, said hanging bar protruding from a face of said display rack, said first end removeably hung on a predetermined crossbar disposed on said first side post and said second end removeably hung on a predetermined crossbar disposed on said second side post.

15. The display rack as described in claim 12 further comprising at least one hanging arm hung on a selected one of said crossbars and protruding therefrom.

16. A display rack for hanging miscellaneous items thereon, said rack comprising:

a first side post and a second side post, each side post having an inner sub-post member and an outer sub-post member, each said inner sub-post member being spaced apart from and parallel to a respective said outer sub-post member, each inner sub-post member and outer sub-post member having an upper end and a lower end;

a third side post having an inner sub-post member and an outer sub-post member, said inner sub-post member being spaced apart from and parallel to said outer sub-post member, said inner sub-post member and outer sub-post member having an upper end and a lower end;

a front row of horizontally parallel crossbars disposed between and connecting together each of said inner and outer sub-post members of said first, second, and third side posts;

a rear row of horizontally parallel crossbars disposed between and connecting together each of said inner and outer sub-post members of said first, second, and third side posts;

a first connection member and a second connection member protruding from the upper end of each of said inner sub-post members and from the upper end of said outer sub-post member of said second post;

a bottom connection member protruding from the lower end of each of said inner sub-post members and from the lower end of said outer sub-post member of said second post;

a front top frame bar having an open first end and an open second end, said first end sliding over and removeably connected to said first connection member of said inner sub-post member of said first side post, said second end sliding over and removeably connected to said first connection member of said upper end of said inner sub-post member of said second side post;

a rear top frame bar having an open first end and an open second end, said rear top frame bar being disposed behind and parallel to said front top frame bar, said first end of said rear top frame bar sliding over and removeably connected to said second connection member of said upper end of said inner sub-post member of said first side post, said second end of said rear top frame bar sliding over and removeably connected to said second connection member of said upper end of said inner sub-post member of said second side post;

a bottom frame bar having an open first end and an open second end, said first end of said bottom frame bar sliding over and removeably connected to said bottom connection member of said lower end of said inner sub-post member of said first side post, said second end of said bottom frame bar sliding over and removeably connected to bottom connection member of said lower end of said inner sub-post member of said second side post;

a second front top frame bar having an open first end and an open second end, said first end sliding over and removeably connected to said first connection member of said upper end of said outer sub-post member of said second side post, said second end sliding over and removeably connected to said first connection member of said upper end of said inner sub-post member of said third side post;

a second rear top frame bar having an open first end and an open second end, said rear top frame bar being disposed behind and parallel to said second front top frame bar, said first end of said rear top frame bar sliding over and removeably connected to said second connection member of said upper end of said outer sub-post member of said second side post, said second end of said rear top frame bar sliding over and removeably connected to said second connection member of said upper end of said inner sub-post member of said third side post;

a second bottom frame bar having an open first end and an open second end, said first end of said second bottom frame bar sliding over and removeably connected to said bottom connection member of said lower end of said outer sub-post member of said second side post, said second end of said second bottom frame bar sliding over and removeably connected to said bottom connection member of said lower end of said inner sub-post member of said third side post; and, an elongated base member removeably attached beneath the lower end of each of said first and second and third side posts.

17. A display rack as described in claim 16 further comprising a connection block connecting together the lower ends of each of said inner sub-post member and outer sub-post member of each said first, second, and third side posts.

18. The display rack as described in claim 16 further comprising at least one hanging bar having a first end and a second end, said hanging bar protruding from, a face of said display rack, said first end removeably hung on a selected one of said crossbars disposed on said first side post and said second end removeably hung on a selected one of said crossbars disposed on said second side post.

19. The display rack as described in claim 16 further comprising at least one hanging arm hung on a selected one of said crossbars and protruding therefrom.

* * * * *